United States Patent [19]

Strobl et al.

[11] 4,156,335

[45] May 29, 1979

[54] METHOD AND APPARATUS FOR STACKING STRIPS HOLDING SECURING ELEMENTS

[75] Inventors: Hans Strobl; Bernhard Grusa, both of Nuertingen, Fed. Rep. of Germany

[73] Assignee: Karl M. Reich Maschinenfabrik GmbH, Nuertingen, Fed. Rep. of Germany

[21] Appl. No.: 895,785

[22] Filed: Apr. 12, 1978

[30] Foreign Application Priority Data

Apr. 30, 1977 [DE] Fed. Rep. of Germany ..... 2719333

[51] Int. Cl.[2] ..... B65B 35/56

[52] U.S. Cl. ..... 53/444; 53/446; 53/64; 53/142; 53/236; 53/245; 414/31; 198/374; 198/406; 221/171

[58] Field of Search ..... 53/444, 446, 64, 142, 53/236, 245, 544; 214/6.5; 198/374, 406; 221/156, 171, 172, 173

[56] References Cited

U.S. PATENT DOCUMENTS

| | | | |
|---|---|---|---|
| 3,290,857 | 12/1966 | Nydam | 53/142 X |
| 3,763,626 | 10/1973 | Pinkepank et al. | 53/142 |

*Primary Examiner*—Travis S. McGehee

*Attorney, Agent, or Firm*—W. G. Fasse; D. F. Gould

[57] ABSTRACT

Strip sections holding securing elements such as nails or screws are stacked, for example, in cartons so that the nail heads or screw heads come to rest in alternate opposite directions. For this purpose the strips slide down an inclined guide chute in a given direction until the heads are held by support elements which are movable alternately and laterally outwardly substantially at right angles to said given direction. Thus, one support element still supports the heads while the other support is withdrawn from the holding position whereby the strips, as they fall downwardly, rotate alternately, through an angle of 90° whereupon the strips are intercepted, for example, by a tiltable chute.

14 Claims, 3 Drawing Figures

METHOD AND APPARATUS FOR STACKING STRIPS HOLDING SECURING ELEMENTS

BACKGROUND OF THE INVENTION

The invention relates to a method and apparatus for stacking strips which hold securing elements or fasteners having a head and a shank. The securing elements such as nails or screws are connected together by at least one retaining strip so that the elements extend in parallel to each other. The securing elements are held in a guide plane freely suspended by their heads by two support members which may be moved away from each other. The securing elements are stacked so that the heads of two adjacent retaining strips point in opposite directions.

This type of securing element strips are made on a so-called collator, as for instance described in German Patent Publication DOS No. 2,507,467. The securing elements may be nails, screws or other securing elements having a head and a shank. For packing strips of securing elements in boxes it is known from German Patent Publication DAS No. 2,255 114 to simultaneously move the support elements holding the strips of securing elements by their heads away from each other. Hereafter strips of securing elements will simply be referred to as "strips".

In the apparatus of German Patent Publication No. 2,507,467 magnetic plates are arranged on either side of the strip, which pick up alternate, falling strips to lay the strips into a box with a pivoting and lowering movement so that consecutive strips are stacked with their heads pointing in opposite directions. For accomplishing this purpose the known apparatus requires numerous levers, joints, compressed air cylinders and control devices which make it expensive to produce and which are susceptible to troubles in operation. Since magnets are used to hold the strips, this known apparatus may only handle securing elements made of magnetizable materials, such as steel, for example. If extraneous bodies should come between the strips and the magnets then the strips are not held securely and proper placing in the box may be prevented.

OBJECTS OF THE INVENTION

In view of the foregoing it is the aim of the invention to achieve the following objects singly or in combination:

to package strips of the type described in such a manner that the heads of the fasteners held in successive strips point in opposite directions;

to provide a packing process which allows a high packing speed;

to provide an apparatus for carrying out the process, which apparatus is simple and inexpensive;

to substantially increase the packing speed as compared to prior art packing of strips of this type;

to assure proper packing of fasteners of any kind of material not necessarily magnetizable material;

to automate the packaging to such an extent that it is merely necessary to remove the full containers; and to simplify the packing apparatus to such an extent that it will not only be less expensive, but also less trouble prone.

SUMMARY OF THE INVENTION

According to the invention there is provided a method for stacking strips wherein strip support elements are alternately moved away from each other so that at any one time, one support element remains in its supporting position and the other support element releases the heads of the fasteners so that each strip carries out a rotating movement about an axis extending parallel to the length of a strip, as a strip is falling down under the influence of gravity, and wherein the strips are collected or intercepted after rotating through 90°.

This process makes it possible to pack the strips as desired in a surprisingly simple way and by means of a reasonably simple apparatus. Compared to the known method, it is possible according to the invention to achieve a considerable increase in the packing speed. Due to the simplification of the apparatus according to the invention, a more reliable and failure-free operating cycle is obtained, and strips holding fasteners made of any kind of material whatsoever may be packaged.

The performance of the process according to the invention is advantageously enhanced or supplemented by means of a container which may be shifted between different elevations and to which the strips are guided in an alternating manner. By the use of proximity sensors, such as proximity switches, which are actuated by the strips, both in the vicinity of the support elements and adjacent to the container means, the invention automates the whole processing sequence, so that it is only necessary to remove the full containers from the packing apparatus.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS

Figure 1:
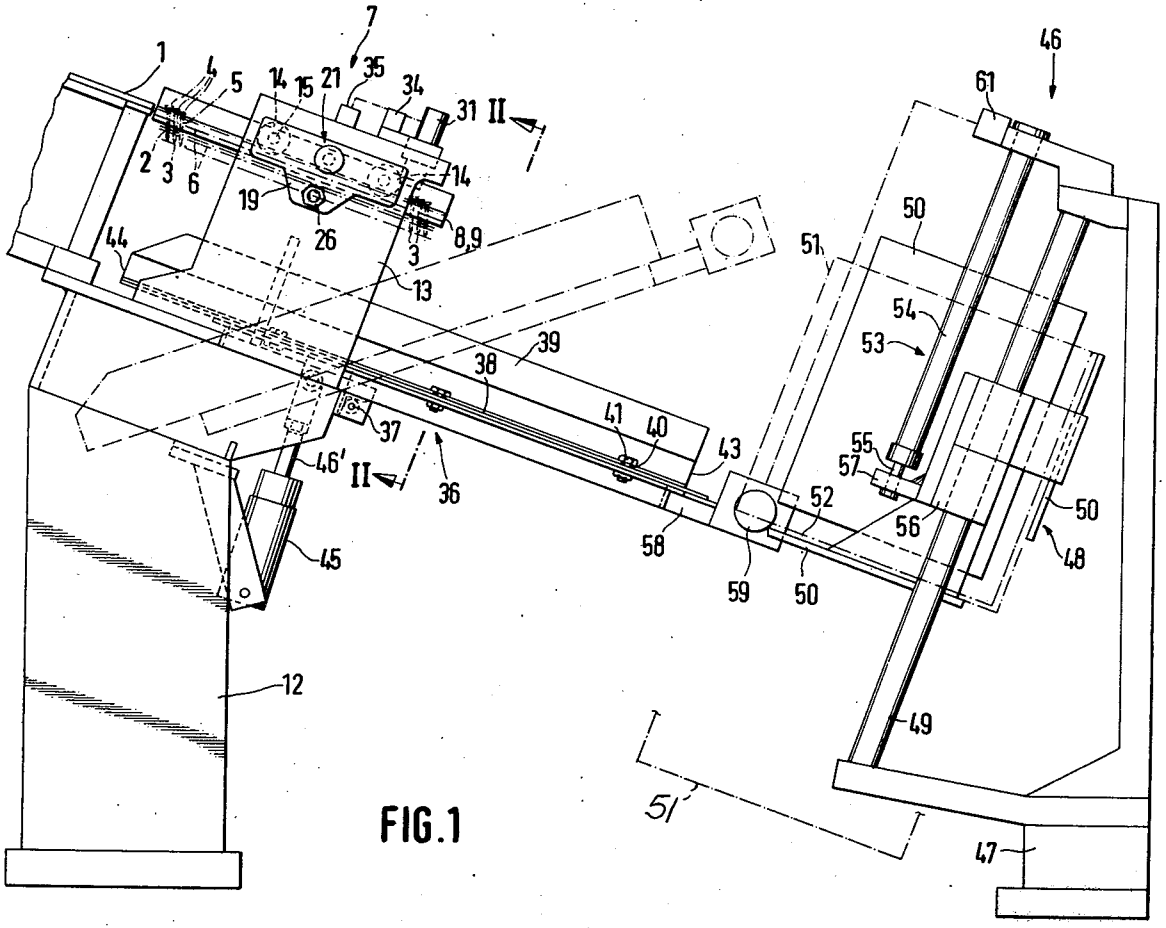
FIG. 1 is a side view of the entire stacking apparatus of the invention.

FIG. 1 shows the delivery end 1 of a collator which is not shown, from which a strip 2 of fasteners is delivered to the stacking apparatus. The individual fasteners 3 each of which has a head 4 and a shank 5, are interconnected by retaining strips 6.

Figure 2:
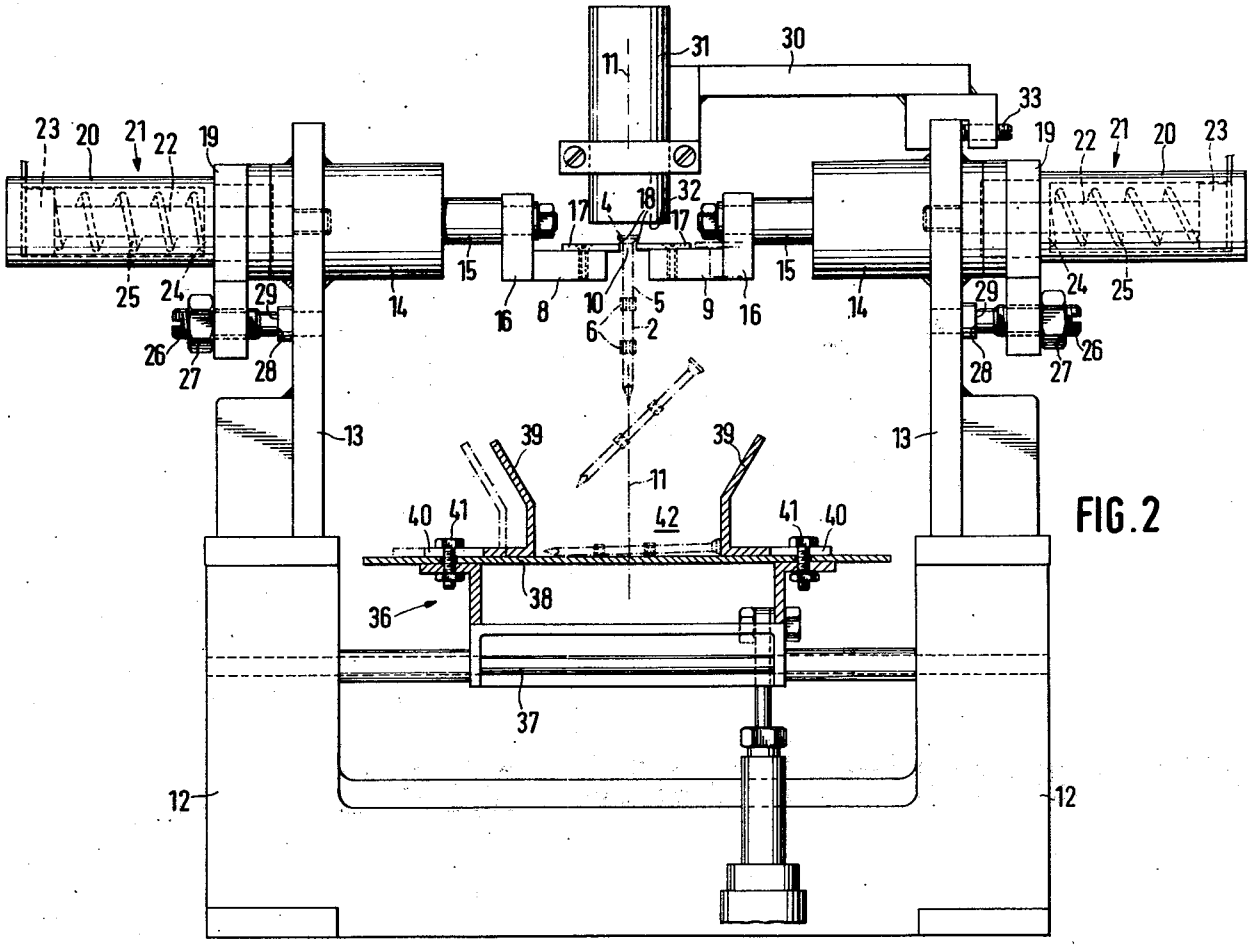
FIG. 2 shows a sectional view along the section line II—II in FIG. 1.

The strip 2 first reaches a tiltable device 7 where it is held by two opposing support elements 8, 9 which freely suspend the strip by the heads 4 of its fasteners in a guide slot 10 (FIGS. 1 and 2). Since both the delivery end 1 of the collator and the support elements 8, 9 are inclined at an angle to the horizontal, the strips 2 slide into the tiltable device 7 under the effect of gravity. The plane which runs through the center of the guide slot 10 is designated as guide plane 11.

The tiltable device 7 comprises a frame 12, the side walls 13 of which carry the support elements 8, 9. For this purpose the side walls 13 are provided with guide sleeves 14 wherein rods 15 are displaceably mounted. These rods 15 are rigidly connected to an angle support 16 to which the two rails 17 are attached. The rails 17 hold with their supporting edges 18 the heads 4 of the fasteners on the strip 2.

Figure 3:
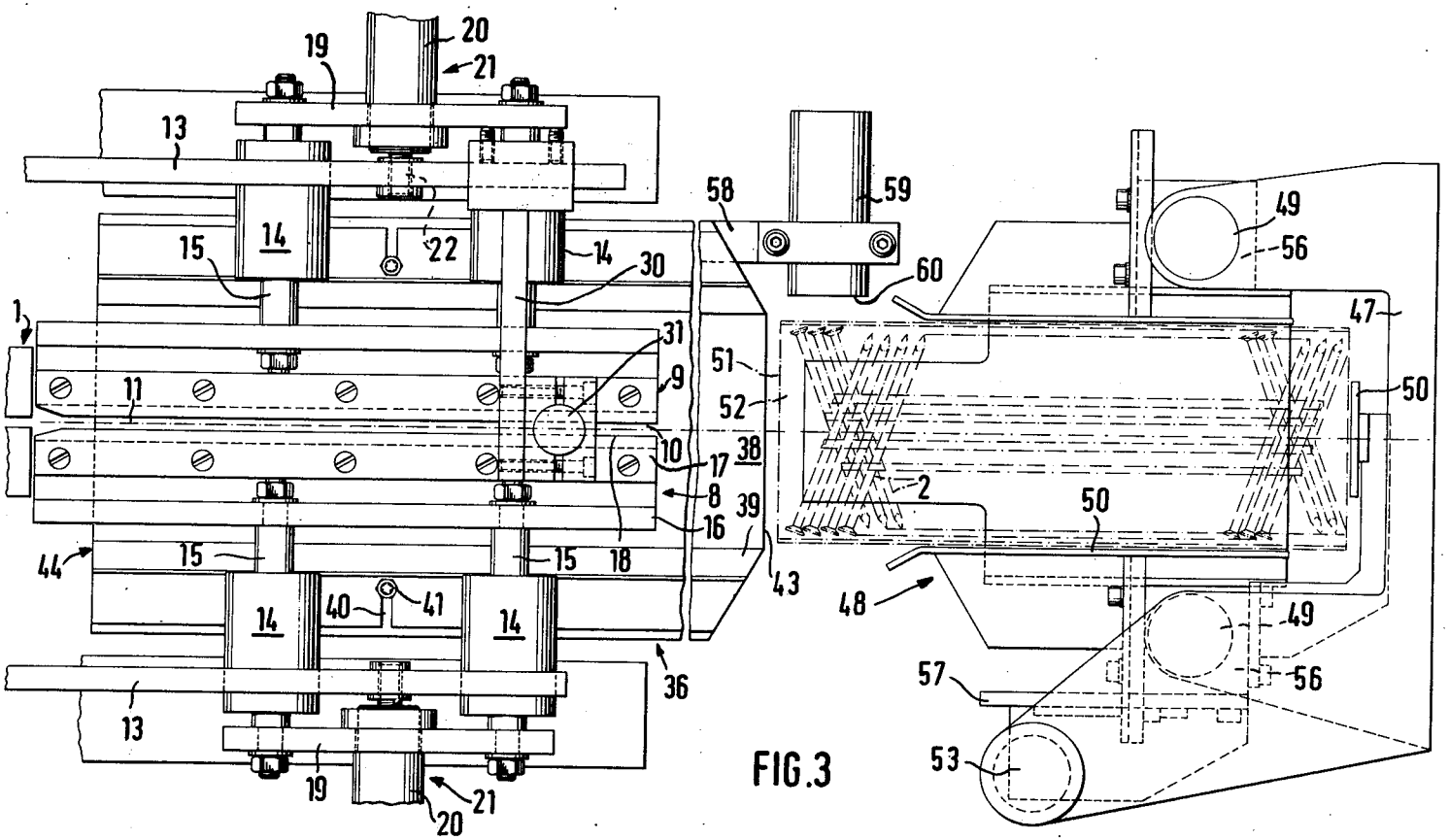
FIG. 3 is a plan view onto the entire stacking apparatus.

As is also shown in FIG. 3, the ends of the rods 15 are rigidly connected to a bridge 19, to which the air pressure cylinder 20 of a displacement unit 21 is also attached. The piston rod 22 of the displacement unit 21 is screwed to the side wall 13. A compression spring 25 is arranged between the piston 23 and the end wall 24 and exerts a force in the direction of the guide slot 10 on the compressed air cylinder 20 and thus, through the bridge 19 and the rods 15, on the support elements 8, 9.

A stop element 26 is connected to the bridge 19. The stop element is, for example, a screw secured by a nut 27. In the rest position of the support elements 8, 9 the end face 28 of the screw rests against a stop face 29 on the side wall 13.

A first proximity switch 31 is attached by means of a bracket 30 to the upper end of a side wall 13 so that its end face 32 is located directly over the heads 4 of the fasteners 3. The bracket 30 is movable towards the side wall 13 and may be secured by screws 33. The inductive proximity switch 31 is electrically connected to a double-throw switch 34 which in turn controls the actuating switches 35 in the form of magnetic valves of the corresponding two displacement units 21.

Below the support elements 8, 9 there is a collecting trough or chute 36 which is mounted to the frame 12 so that it may be tilted about an axis 37. The chute 36 comprises a base plate 38 running parallel to the support elements 8, 9. Two opposite side plates 39 which can be moved perpendicularly to the guide plane 11 are attached to the base plate 38. For this purpose, the side plates 39 are provided with longitudinal slots 40 and screws 41 attached to the base plate 38, engage in said slots 40. The collecting chute 36 thus defines a trough 42 of variable width which widens towards the top in the form of a hopper and which is provided with a first outlet 43 facing in the normal transportation direction of the strips 2 and a second outlet 44 facing in the opposite direction. An air pressure cylinder 45 is attached to the frame 12 for pivoting the collecting chute 36. The piston rod 46' of the cylinder 45 is connected to the collecting trough.

Downstream of the first outlet 43 of the collecting chute 36 there is arranged a packing device 46 having a frame 47 on which a container holder 48 is mounted on two guide rods 49 so that its elevational position may be adjusted (FIGS. 1 and 3). The container holder 48 with its walls 50 serves to hold a container 51 such as a box folded up by the operator, for instance, which is open in the direction of the first outlet 43 and which has a base 52.

For adjusting the height or elevational position of the container holder 48 there is a lowering unit 53 having a compressed air cylinder 54 which is attached to the frame 47 and the piston rod 55 of which acts on the container holder 48. For this purpose a guide sleeve 56 on the container holder 48 is equipped with a flange 57.

A second proximity switch 59 is attached to the collecting chute 36 via a bracket 58 in such a way that its end face 60 is in the immediate vicinity of one side wall of the container 51. The inductive proximity switch 59 is electrically connected to an actuating switch 61 in the form of a magnetic valve of the lowering unit 53.

The present apparatus operates as follows. It will be assumed that a strip 2 slides from the delivery end 1 under the effect of gravity into the guide slot 10 of the tilting device 7. When its front end arrives under the first proximity switch 31, the switch 31 is energized so that it operates one of the actuating switches 35 through the double-throw switch 34 so that the compressed air cylinder 20 shown on the right in FIG. 2, for example, is pressurized. The piston of cylinder 20 moves against the effect of the compression spring 25, away from the guide plane 11, and thereby entrains the support element 9 through the bridge 19 and the rods 15, until the angle support 16 strikes against the side wall 13. The heads 4 of the fasteners in the strip 2 are thus held only by the supporting edge 18 of the support element 8 and the strip 2 tilts away from the support element 8 as is shown in FIG. 2, thereby carrying out a clockwise rotary movement. Thus, it falls onto the inclined base plate 38 and slides over this base plate through the first outlet 43 into the container 51, the base 52 of which is held slightly below the base plate 38 of the container holder 48. The strip 2 thereby influences the second proximity switch 59, which causes the lowering of the container holder 48 by means of the operating switch 61 and the lowering unit 53, until the newly stacked strip 2 lies below the base plate 38.

In the tilting device 7 the support element 9 is returned again to its rest position under the effect of the compression spring 25 after the strip 2 has been removed. The next strip 2 which enters the tilting device 7 again influences the first proximity switch 31. This time, however, it actuates the displacement unit 21 shown on the left through the double-throw switch 34. Therefore, the support element 8 is moved away from the strip 2 and the latter tilts over in the direction opposite to clockwise, onto the base plate 38. As a result, the strip 2 arrives in the container in an orientation in which its heads 4 point in a direction opposite to those of the preceding strip. This process is repeated until the container 51 is full and the container holder 48 assumes the dashed line position shown in FIG. 1. The container 51 is then taken off by the operator and replaced by an empty container and the container holder is returned into the position drawn in full lines in FIG. 1.

When the container 51 is removed or when making repairs in the stacking device 46, the collecting chute 36 may be pivoted into the dashed line position shown in FIG. 1 by operation of the air pressure cylinder 45. The strips 2 which tilt off then leave the collecting chute 36 through the second outlet 44 and fall into a container arranged there below. This means that the entire collator does not have to be switched off during a brief stoppage of the packing device 46. By adjusting the stop elements 26, the guide slot 10 may be adapted to suit different diameters of shanks 5. The side plates 39 are also adjustable as indicated by the dashed line to adapt the width of the trough 42 to fasteners of different lengths.

Although the invention has been described with reference to specific example embodiments, it is to be understood that it is intended to cover all modifications and equivalents within the scope of the appended claims.

What is claimed is:

1. A method for stacking strips of fasteners having heads and which are held in parallel to each other by a retainer strip comprising the steps of supporting the heads by means of two oppositely arranged support elements, alternately moving the support elements away from the heads so that at any time one support element remains in its supporting position while the other support element releases the fastener heads so that the strips tilt in a rotating movement in alternately opposite directions about an axis extending in parallel to their length as the strips fall down under the influence of gravity, and collecting the strips after they have rotated through about 90° whereby said heads of fasteners in adjacent strips point in opposite directions after collection.

2. The method of claim 1, further comprising using the strips for the control of the strip handling by influencing first sensor means by means of a strip reaching the supported position in which the strip is held by said support elements, causing the alternate withdrawal of the support elements through the actuation of said sensor by a strip, collecting a falling and rotating strip into a container, actuating second sensor means by said strip as it is being collected and using said second sensor means for shifting said container downwardly.

3. The method of claim 2, further comprising collecting said falling and rotating strip on a guide chute which channels the strip into said container.

4. An apparatus for stacking strips of fasteners comprising strip holding elements arranged opposite each other to form a gap for receiving a strip therein, power operated displacement means operatively connected to said strip holding elements for alternately moving the strip holding elements away from said gap, and actuation means for alternately actuating said displacement means, whereby the strips tilt in a rotating movement in alternately opposite directions about an axis extending in parallel to their length as the strips fall down under the influence of gravity.

5. The apparatus of claim 4, wherein said displacement means for said support elements comprise adjustable stop means (26) for limiting the movement of the support elements.

6. The apparatus of claim 4, wherein said actuation means comprise first proximity sensor means located in the vicinity of the support elements (8, 9) for sensing a strip in the gap, said actuation means further comprising double-throw switch means (34) and actuating switch means (35) responsive to said sensor means for operating the respective displacement means (21).

7. The apparatus of claim 6, further comprising means for movably securing said first sensor means in the apparatus for movement in the longitudinal direction of the support elements (8, 9), and means for securing the sensor means in an adjusted position in the apparatus.

8. The apparatus of claim 4, further comprising collecting chute means (36) operatively positioned under the support elements (8, 9), said chute means having a first outlet (43) and a second outlet (44) for the strips (2), and deflector means (36, 46) operatively arranged for conducting the strips (2) to one of the outlets.

9. The apparatus of claim 8, further comprising journal means (35) for mounting the collecting chute (36) in the apparatus for tilting about an axis which extends perpendicular to a guide plane in which said strips move.

10. The apparatus of claim 8, wherein the collecting chute (36) comprises a base plate (38) and two adjustable side plates (39) arranged perpendicular to said guide plane.

11. The apparatus of claim 8, further comprising container holder means (48) arranged in the vicinity of the first outlet (43) of the collecting chute (36).

12. The apparatus of claim 11, further comprising lowering means (53) operatively connected to the container holder (48) and second proximity sensor means (59) operatively positioned to be influenced by a strip (2) being collected, and means responsive to said second sensor means for actuating said lowering means.

13. The apparatus of claim 12, wherein said means responsive to said second sensor means comprise actuating switch means (61).

14. The apparatus of claim 12, wherein said second proximity sensor means (59) are connected to the collecting chute (36).

* * * * *